US005190270A

United States Patent [19]

Huston

[11] Patent Number: 5,190,270

[45] Date of Patent: Mar. 2, 1993

[54] APPARATUS FOR ERECTING FOUNDATION REINFORCING BARS AND THE LIKE

[76] Inventor: Jerry D. Huston, 3248 Cascade Blvd., Redding, Calif. 96003

[21] Appl. No.: 730,494

[22] Filed: Jul. 16, 1991

[51] Int. Cl.[5] ..... B25B 1/20

[52] U.S. Cl. ..... 269/41; 269/904; 411/438

[58] Field of Search ..... 254/231; 29/259; 411/438, 16, 17; 269/904, 41, 246

[56] References Cited

U.S. PATENT DOCUMENTS

| | | | |
|---|---|---|---|
| 563,409 | 7/1896 | Pickford | 254/231 |
| 1,611,410 | 12/1926 | Bryant | 254/231 |
| 2,360,417 | 10/1944 | Grenfell | 269/904 |
| 2,680,459 | 6/1954 | Dodson et al. | 269/904 |
| 3,160,988 | 12/1964 | Williams | 411/438 |
| 3,216,171 | 11/1965 | Jenkins | 411/438 |
| 3,846,898 | 11/1974 | Kerr | 29/259 |
| 4,380,329 | 4/1983 | Nunno | 269/904 |

*Primary Examiner*—Robert C. Watson
*Attorney, Agent, or Firm*—Schapp and Hatch

[57] ABSTRACT

A rebar clamp for clamping rebars to templates during the pouring of footings and the like is disclosed. The disclosed rebar clamp includes a body in the form of a helical coil and a screw member threadedly engaged with the helical coil and having a transverse handle at its outer end. A pair of arms are affixed to the opposite sides of the helical coil and are spread wide enough apart to embrace a template of well known type across its major dimension. The outer of each arm is provided with a hook which can tightly engage a rebar and firmly clamp it against one major face of the template when the screw member is rotated in such manner as to advance it against the opposite major face of the template.

1 Claim, 2 Drawing Sheets

APPARATUS FOR ERECTING FOUNDATION REINFORCING BARS AND THE LIKE

BACKGROUND OF THE INVENTION

1. Field of the Invention

My present invention relates to the construction of building foundation walls, retaining walls, and the like, and more particularly to methods and apparatus for erecting foundation reinforcing bars (rebars) and maintaining the same in position during the pouring of footings for such walls.

2. Description of the Prior Art

The term "prior art" as used herein or in any statement made by or on behalf of applicant means only that any document of thing referred to as prior art bears, directly or inferentially, a date which is earlier than the effective filing date hereof.

It is known in the prior art to incorporate reinforcing bars (rebars) in the footings for building foundation walls, retaining walls, etc., by suitably positioning such reinforcing bars within the form in which the footing is to be poured, pouring the concrete of the footing into the form, and after the setting of the concrete removing the supporting means by which the reinforcing bars were theretofore maintained in position.

Typically, such rebar supporting means are comprised of a plurality of round, solid metal stakes, sometimes called "form stakes", which are driven into the earth floor of the footing form, or into the earth closely adjacent to the footing form.

Horizontal wooden beam members, sometimes collectively called the "template", are then nailed to the form stakes by means of nails passing through suitable holes provided in the form stakes.

The template commonly consists of one or more lengths of that kind of lumber commonly referred to as "two-by-fours", and is most commonly located close to the top of the footing form, i.e., about one-half inch thereabove.

The footing rebars are then affixed to the template, each in such a position that after the pouring of the footing, and the setting of the poured concrete, a large portion of each rebar is captive within the concrete, and another portion of each rebar projects upwardly from the upper surface of the poured concrete, i.e., upward from the upper surface of the footing.

Conventionally, the footing rebars are affixed to the template either by toenailing or by bailing wire wrapped around each rebar and the adjacent portion of the template.

This prior art method of footing rebar erection and positioning, however, suffers from certain inherent deficiencies.

The affixation of the rebars to the template by bailing wire is both time-consuming and expensive. That is to say, the wrapping of bailing wire around the rebar (vertical) and template (horizontal) involves considerably manual labor, which is costly at current labor rates, and also involves delays in completing a typical foundation wall or retaining wall.

The affixation of the retaining bars to the template by toenailing, while perhaps less time-consuming than affixation by bailing wire, involves the risk of displacing the template or loosening the form stakes by repeated hammer blows, resulting in the deviation of the rebars from their optimum position. As is well known to those having ordinary skill in the art, however, mispositioning of the rebars can have a deleterious effect on wall strength, and can obtrude difficulties in pouring the upper reaches of a wall, since the rebars in the wall are attached and aligned with to the rebars which extend upward from the footing.

A reinforcing bar aligner and clamp is shown and described in U.S. Pat. No. 4,074,897, issued to Fredrick H. Behn on Feb. 24, 1978.

The device of the Behn patent, however, is adapted to hold a first reinforcing bar in fixed end-to-end relation to a second reinforcing bar while they are being spliced together, and its structure appears to be radically different from the structure of applicant's invention.

Various clamps for clamping vertically disposed members to horizontal members are shown in the prior art, e.g., in U.S. Pat. Nos. 884,772 and 4,369,945.

It is believed that the documents listed immediately below contain information which is or might be considered to be material to the examination of this patent application.

U.S. Pat. No. 2,105,954
U.S. Pat. No. 2,892,207
U.S. Pat. No. 3,345,061
U.S. Pat. No. 4,139,189
U.S. Pat. No. 4,750,662

No representation or admission is made that any of the above-listed documents is part of the prior art, or that a search has been made, or that no more pertinent information exists.

A copy of each of the above-listed United States patents is supplied to the Patent and Trademark Office herewith.

SUMMARY OF THE INVENTION

Accordingly, it is an object of my present invention to provide methods and apparatus for fixedly positioning rebars in footing forms, etc.

Another object of my present invention is to provide methods and apparatus for positioning rebars in footing forms and the like with great rapidity and accuracy, and at the lowest possible labor cost.

Yet another object of my present invention is to provide methods and apparatus for positioning rebars in footing forms without securing those rebars to their associated templates by means of bailing wire or the like.

A yet further object of my present invention is to provide methods and apparatus for positioning rebars in footing forms and the like without toenailing, and thus to eliminate the attendant risk of displacing the template and the other rebars borne thereby, and also to eliminate the risk of loosening the ground-supported ends of the form stakes to which the template is attached.

Another object of my present invention is to provide clamping means for clamping rebars to templates, which clamping means are inexpensive to manufacture and have a very long service life, and yet at the same time are easy to install rapidly and accurately and thus to accurately position the rebars supported by the template and to maintain those rebars in the optimum position throughout the footing pouring operation.

Another object of my present invention is to provide clamping means for clamping rebars to their associated templates, the operation of which clamping means is unimpeded by an accidental incrustation of concrete.

An additional object of my present invention is to provide clamping means for clamping rebars to their associated templates, which clamping means are adapted to efficiently cooperate with a wide range of rebar sizes, i.e., rebar diameters.

A yet further object of my present invention is to provide clamping means for clamping rebars to their associated templates, which clamping means can be operated rapidly even by a gloved hand, and requires no tools for its installation or removal.

Other objects of my present invention will in part be obvious and will in part appear hereinafter.

My present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of may present invention will be indicated in the claims appended hereto.

In accordance with a principal feature of my present invention clamping means are provided for clamping rebars to associated templates, each of which clamping means is comprised of a pair of arms terminating at their outer ends in hook members, said hook members being spaced sufficiently far apart to pass between them the major transverse dimension of an associated template.

In accordance with another principal feature of my present invention said hook members are so configured as to firmly engage a wide range of rebar sizes, i.e., rebar diameters.

In accordance with another principal feature of my present invention the inner ends of said arms, which are offset from the outer ends thereof, are longitudinally affixed to opposite sides of a rigid coil member. Said coil member serves as an internally threaded member for threadedly engaging the shank of a screw member. The inner end of said screw member forcibly engages the side of the template remote from the rebar when a rebar is clamped to that template by the clamping means of my invention.

In accordance with a yet further principal feature of my invention the outer end of said screw member is provided with a wing handle of such size as to be easily manipulated by a gloved hand.

In accordance with an additional principal feature of my invention the contour of said screw member is of a type well known for its property of readily divulsing concrete inadvertently adhered thereto.

For a fuller understanding of the nature and objects of my present invention, reference should be had to the following detailed description, taken in connection with the accompanying drawings.

DESCRIPTION OF THE PREFERRED EMBODIMENT

Figure 1:
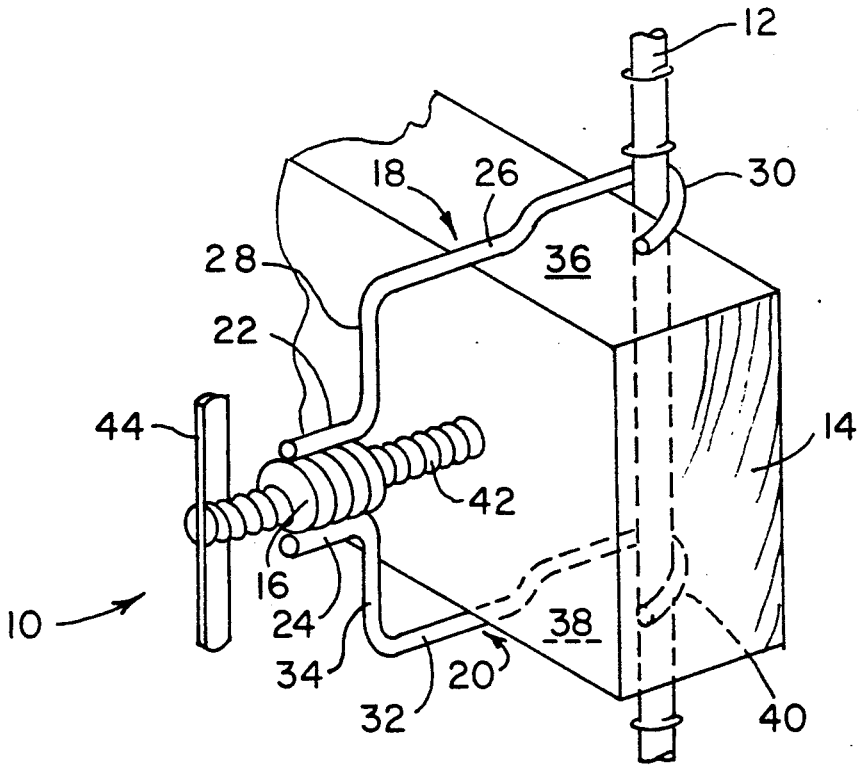
FIG. 1 is a partial perspective of view of a conventional reinforcing bar joined to a conventional template by a clamp constructed in accordance with the preferred embodiment of my invention.

Referring now to FIG. 1, there is shown a reinforcing bar (rebar) clamp 10 of the preferred embodiment of my invention clamping a rebar 12 to a template 14 in accordance with the method of my invention.

As is well known to those having ordinary skill in the art, footings for foundation walls, retaining walls, and the like commonly contain the lower ends of arrays of rebars, which rebars are fixedly positioned with their lower ends located within the footing form before the footing is poured.

In order to thus fixedly position these reinforcing bars so that they will remain positioned during the pouring of the footing, it is conventional to position an elongated wooden member called a "template" a short distance, e.g., one-half inch, above the footing form by securing it to the upper ends of a plurality of vertical stakes, sometimes called "form stakes", the lower ends of which are driven into the earth which forms the bottom of the footing form.

These form stakes are formed from round, solid steel rod stock and are provided with holes adapted to accommodate suitable nails by means of which the sections of the template are affixed to their associated form stakes.

Conventionally, each template section is joined to its associated form stakes either by wrappings of bailing wire or the like or by toenailing.

As is well known to those having ordinary skill in the art, however, neither of these methods of affixing template sections to their supporting form stakes is entirely satisfactory.

The wire wrapping method of joining template sections to form stakes requires that the wrapping wire be passed several times around the intersection of the rebar and the template while the rebar is held in its required position. This joining operation, carried out for each of a large number of joints, involves considerable labor cost, both during the joining of the rebars to the template and the removal of the wire wrappings from each joint after the pouring and setting of the footing.

The conventional toenailing method, while perhaps involving less labor cost, also involves the risk of displacing the form stakes or loosening their lower ends from the earth which provides the bottom of the footing form.

Referring again to FIG. 1, it will be seen that the rebar clamp 10 of the preferred embodiment of my invention is comprised of a body 16 which is a one-layer cylindrical coil consisting of a few turns of a rigid steel rod or wire the adjacent turns of which are in intimate contact or joined together, as by resistance welding.

As further seen in FIG. 1, rebar clamp 10 of my invention is further comprised of two arms 18, 20, each including a short inner part 22, 24 which is affixed to the exterior of body 16, as by welding or brazing.

As seen in FIG. 1, inner end 22 of arm 18, when fixed to body 16 in accordance with my invention, lies parallel to the axis of body 16, i.e., the axis about which body 16 was wound.

Similarly, inner end 24 of leg 20 is affixed to the outside of body 16, as by welding or brazing, and lies parallel to the axis of body 16.

As also seen in FIG. 1, inner end 22 is parallel to inner end 24, and is positioned opposite inner end 22, i.e., with the axis of body 16 contained in the same plane as inner ends 22, 24.

As also seen in FIG. 1, arm 18 is further comprised of an outer end 26 and an integral intermediate portion 28 extending between inner end 22 and outer end 26.

As also seen in FIG. 1, outer end 26 terminates in a hook portion 30 which is adapted to embrace rebar 12.

Similarly, the outer end 32 of arm 20 is integrally joined to inner end 24 by intermediate portion 34.

Outer end 32 of arm 20 terminates in a hook which is substantially identical to hook 30.

As will be evident to those having ordinary skill in the art from FIG. 1, outer ends 26, 32 are parallel to each other and parallel to inner ends 22, 24.

Figure 4:
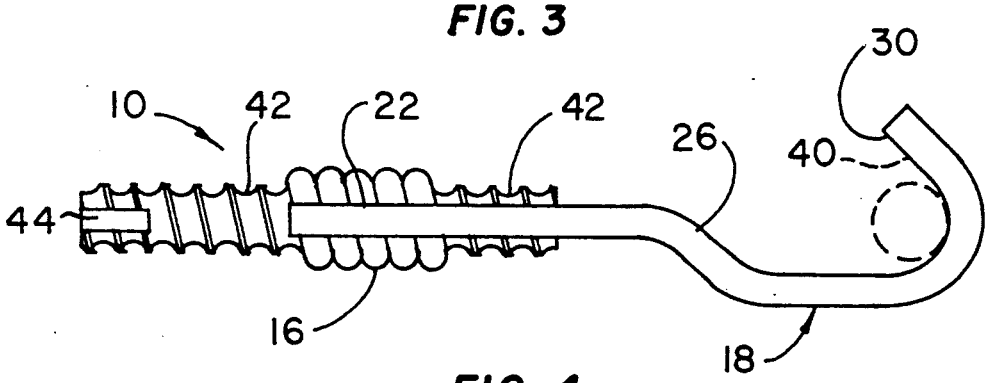
FIG. 4 is an elevational view of the rebar clamp of my invention shown in FIG. 3, showing the coaction thereof with a rebar of small diameter.

As also seen in FIG. 4, outer ends 26, 32 of arms 18, 20 are spaced apart by slightly more than the width of a standard two-by-four timber, from which material rebar templates are conventionally fashioned.

It will also be evident to those having ordinary skill in the art, in view of FIG. 1, that the plane of hook 30 and the plane of its associated hook (in which outer end 32 terminates) are parallel, and are spaced apart by the same distance as the straight portions of outer end 26 and outer end 32, such that they may readily be simultaneously passed over the opposite minor faces 36, 38 of template 14.

The particular shape of hook 30 and its associated, opposing hook 40 will be described hereinbelow in connection with FIGS. 3 and 4.

As further seen in FIG. 1, rebar clamp 10 is further comprised of an externally threaded rod or screw member 42 which passes through coiled body 16 and is threadedly engaged with the turns thereof.

The central portion of an elongated bar 44 is affixed, as by welding, to the end of screw member 42 remote from hooks 30, 40. Bar 44 is substantially perpendicular to the axis of screw member 42, and is substantially bisected by the axis of screw member 42.

The length of the outer ends 26, 32 of arms 18, 20 is such that when screw member 42 is substantially completely withdrawn into coiled body 16, i.e., bar or handle 44 is as remote as it can be from body 16 without withdrawing screw member 42 from body 16, arms 18, 20 can pass respectively above and below template 14 (FIG. 1) until hooks 30, 40 are sufficiently far behind template 14 (FIG. 1) so that they can be both engaged with rebar 12 even when rebar 12 is a No. 8 rebar, i.e., is one inch in diameter.

The length of screw member 42 is such that when arms 18, 20 have been passed around template 14, and hooks 30, 40 engaged with rebar 12 as immediately hereinabove described, rebar 12 can be firmly clamped to template 14 by rotating screw member 42 by means of handle 44 until the inner (handle-opposed) end of screw member 42 bears firmly against the outer face of template 14 and hooks 30, 40 draw rebar 12 tightly against the opposite major face of rebar 14, even when rebar 12 is a No. 3 rebar, i.e., is three-eights of one-inch in diameter.

Figure 2:
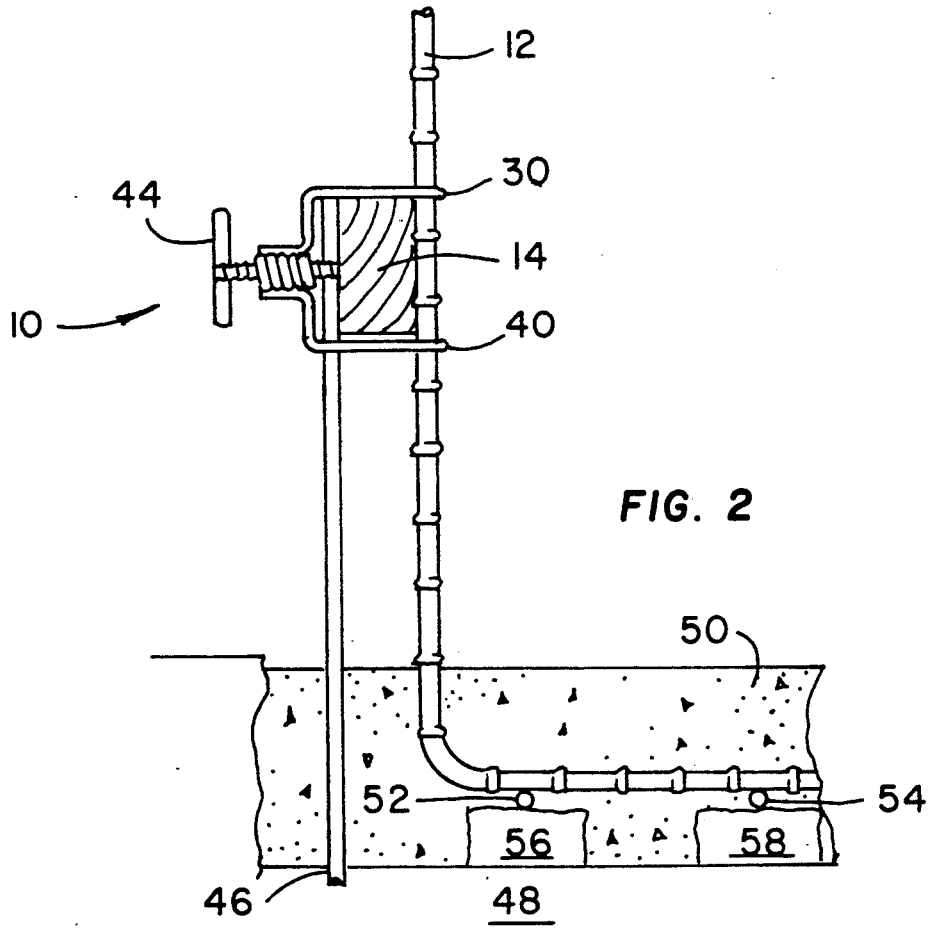
FIG. 2 is a sectional view in elevation of a footing poured in accordance with the method of my invention, after the setting of the footing but before the removal of the clamps of my invention from the joints between the reinforcing bars and the templates.

Referring now to FIG. 2, there is shown an installation of a rebar clamp 10 of my invention wherein clamp 10 is serving to secure rebar 12 to template 14, template 14 being affixed to a plurality of form stakes, including form stake 46, in the well known manner. As is well known to those having ordinary skill in the art, the template is more commonly located about one-half inch above the top face of the footing form.

As seen in FIG. 2, form stake 46, along with its associated form stakes, were initially driven into the earth 48 which forms the bottom of the form into which footing 50 has been poured.

As seen in FIG. 2, footing 50 has been poured but form stakes 46, etc., template 14, and the associated rebar clamps 10 of my invention, have not yet been removed.

It is to be understood that in preparing to pour footing 50 a suitable array of form stakes 48, etc., is first erected by driving them into the earth 48 at the bottom of the form trench, a plurality of longitudinal rebars 52, 54 are laid on blocks 56, 58, called "dobies", which are themselves disposed on the bottom of the form trench, the sections of template 14 are secured to form stakes 46, etc., by nailing, and L-shaped rebars 12, etc., are successively disposed on transverse rebars 52, 54, with their vertical portions resting against template 14.

As each successive rebar 12, etc., is thus emplaced within the footing form, and brought to rest against template 14, a rebar clamp 10 of my invention is passed around template 14, its hooks engaged with rebar 12, and handle 14 rotated until rebar 12 is firmly clamped to template 14.

As will be understood by those having ordinary skill in the art, informed by the present disclosure, the order of steps set out hereinabove is not followed in preparation for pouring every footing, nor is the same configuration and combination of rebars employed. Rather, it is to be understood that the abovedescribed sequence of preparation steps is merely typical, and not limiting of my invention.

It is further to be understood that the use of the rebar clamp of my invention is not limited to the erection of rebars in the pouring of footings. Rather, many uses for rebar clamps embodying my invention will occur to those having ordinary skill in the building trades.

Figure 3:
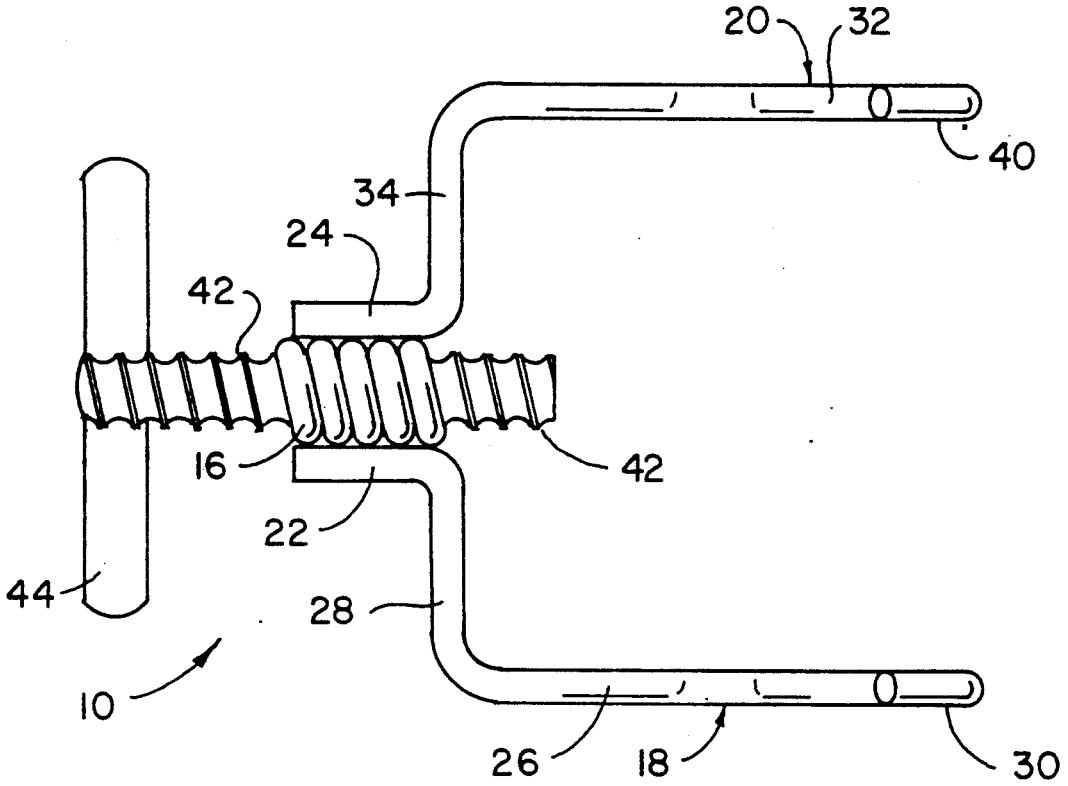
FIG. 3 is a plan view of a rebar clamp of my invention, seen as disposed upon a horizontal surface.

Referring now to FIGS. 3 and 4, it is too be understood that the distance A between the outer arm portions 26, 32 of rebar clamp 10 of the preferred embodiment is at least $3\frac{5}{8}$ inches.

It will also be understood that in FIGS. 3 and 4 the distance B between body 16 and the outer ends of hooks 30, 40 will be at least $3\frac{1}{4}$ to $3\frac{1}{2}$ inches.

In the preferred embodiment the distance C between body 16 and the outwardmost position of screw member 42 will be $1\frac{3}{4}$ inches.

In a second preferred embodiment of my invention dimensions A and B will be at least $1\frac{5}{8}$ inches and at least $5\frac{1}{2}$ to $5\frac{3}{4}$ inches, respectively.

Figure 5:
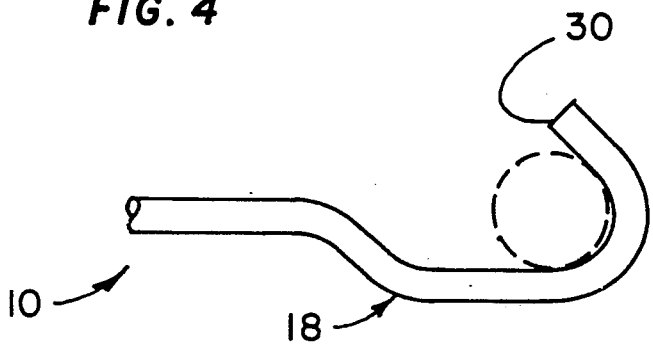
FIG. 5 is a partial elevational view of a rebar clamp of my invention, showing the coation thereof with a rebar of large diameter.

It is further to be understood that the configuration of the outer ends 26, 32 of arms 18, 20, as shown in FIGS. 4 and 5, is a particular feature of my invention. In particular, it is to be noted that the angular, rather than curvilinear, shape of hooks 30, 40 (FIGS. 4 and 5) which permits rebar clamp 10 to be used in connection with a wide range of rebar diameters (No. 3 through No. 8) is another principal feature of my invention. The coaction of hooks 30, 40 with a small diameter rebar is shown in FIG. 4. The coaction of hooks 30, 40 witha large diameter rebar is shown in FIG. 5.

As will also be evident to those having ordinary skill in the art, upon review of FIGS. 3 and 4, the thread of screw member 42 is of the kind used in coil bolts, which bolts are designed for use in connection with coil ties and loops wherein the bolt is threaded into a helical coil, rather than a nut. This type of thread is coarse, and is not easily damaged or clogged. Coil bolts provided with such threads are sold by Dayton Superior Concrete Accessories, Inc., of Santa Fe Springs, Calif. for use in connection with their coil ties and coil loops.

It will thus be seen that the objects set forth above, among those made apparent from the preceding description, are efficiently attained, and since certain changes may be made in the above constructions and the methods carried out thereby without departing from the scope of my present invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. The combination comprising:

stake means driven into the ground and thereby maintained in substantially vertical orientation;

beam means attached to said stake means and thereby maintained in substantially horizontal orientation; and concrete reinforcing bars clamped to said beam means by clamping means;

each of said clamping means comprising:

a body member defining an internally threaded passage;

first arm means having an inner portion and an outer portion, said outer portion terminating in a hook adapted to embrace a reinforcing bar and said inner portion being affixed to said body member and maintaining said outer portion substantially parallel to the axis of said passage;

second arm means having an inner portion and an outer portion, said outer portion terminating in a hook adapted to embrace a reinforcing bar and said inner portion being affixed to said body member and maintaining said outer portion substantially parallel to the axis of said passage; and screw means threadedly engaged in said internally threaded passage;

said outer arm portions being spaced apart by more than a transverse dimension of said supporting means and being of such length that when they transversely embrace said supporting means and said screw means is fully withdrawn into said passage said hooks can be engaged with a reinforcing bar which is in contact with the face of said supporting means opposite said body member.

* * * * *